US005080993A

United States Patent [19]

Maruta et al.

[11] Patent Number: 5,080,993

[45] Date of Patent: Jan. 14, 1992

[54] METHOD TO PRODUCE A PHOTORECEPTOR FOR ELECTROPHOTOGRAPHY USING DIAMOND BITE FOLLOWED BY ETCHING

[75] Inventors: Yukihiro Maruta; Toshinao Ishizone, both of Nagano, Japan

[73] Assignee: Fuji Electric Co. Ltd., Kawasaki, Japan

[21] Appl. No.: 409,122

[22] Filed: Sep. 19, 1989

[30] Foreign Application Priority Data

Sep. 20, 1988 [JP] Japan ..... 63-235461

[51] Int. Cl.[5] ..... G03G 5/10

[52] U.S. Cl. ..... 430/128; 430/69; 430/131; 427/292; 427/307; 51/323; 51/DIG. 2

[58] Field of Search ..... 427/76, 327, 307, 292, 427/295, 250, 124; 430/69, 128, 131

[56] References Cited

U.S. PATENT DOCUMENTS 4,492,745 1/1985 Mimura et al. ..... 430/67

4,514,483 4/1985 Matsuura et al. ..... 430/84

4,735,883 3/1988 Honda et al. ..... 430/69

OTHER PUBLICATIONS

Japanese Industrial Standard; Waviness, translated and published by Japanese Standard Association; pp. 1-5.

*Primary Examiner*—David Welsh

*Attorney, Agent, or Firm*—Brumbaugh, Graves, Donohue & Raymond

[57] ABSTRACT

The present invention relates to a method for producing a photoreceptor for electrophotography. An aluminum base substrate is worked so that the $R_{max}$ is between 1.3 and 1.8 microns, with a filtered maximum waviness not exceeding 0.5 microns. The substrate is etched with an aqueous solution of alkali, and then etched with an aqueous solution of nitric acid to form an oxide thin film. A Se-As alloy is vacuum deposited thereon to form a light sensitive layer. This photoreceptor is flat and smooth so that the images obtained by electrophotography are substantially free from white point defects.

2 Claims, 1 Drawing Sheet

METHOD TO PRODUCE A PHOTORECEPTOR FOR ELECTROPHOTOGRAPHY USING DIAMOND BITE FOLLOWED BY ETCHING

This application claims priority under Japanese Patent Application No. 63-235461 filed Sept. 20, 1988.

BACKGROUND OF THE INVENTION

The present invention relates to a method for producing a photoreceptor for electrophotography. It comprises a method for working the surface of an aluminum substrate and vacuum-depositing a Se-As alloy thereon, so that the photoreceptor produces images substantially free from white point defects.

Aluminum substrates with Se-As alloy photosensitive layers deposited thereon have been used as photoreceptors. In preparing such photoreceptors, it has been the general practice to grind the aluminum substrate to provide a surface suitable for vacuum-depositing of the Se-As alloy. The conventional method of grinding the aluminum substrate with cylindrical o square grindstones and then washing the substrate with an organic solvent results in burr formation on the surface of the aluminum substrate, wastage of grindstone grinding cutting into the aluminum substrate, and flaw formation o the surface of the aluminum substrate due to the loading of the grindstone. For example, the various problems are shown in FIG. 4, in which 1 depicts an Al substrate, 2 depicts a photosensitive layer, and 3 depicts a defect. FIG. 4(*a*) shows a pinhole 3 formed by an Al burr 4, FIG. 4(*b*) shows a pinhole 3 formed by wastage 5 of grindstone grinding, and FIG. 4(*c*) shows a pinhole 3 formed by a flaw 6 caused by loading of grindstone. If a photoreceptor having a photosensitive layer with such pinholes is used, white point defects of obtained image appear in parts corresponding to the pinholes. As a result of these defects, there is poor adhesion of the Se-As alloy to the substrate, and the Se-As layer has flaws and pinholes, which cause white point defects on the corresponding parts of the image obtained.

The object of the present invention is to provide a method for producing a photoreceptor having substantially reduced defects in the vapor-deposited Se-As alloy on an aluminum base substrate. This provides a good picture image, having few white point defects.

SUMMARY OF THE INVENTION

The above-mentioned object is attained by a method wherein the surface of the aluminum base substrate is worked by a diamond bite so that the $R_{max}$ height of the surface is at least 1.3 microns and not in excess of 1.8 microns, and the filtered maximum waviness is not in excess of 0.5 micron. The aluminum substrate is then etched with an aqueous solution of alkali, and optionally further etched with an aqueous solution of nitric acid. Thereafter, a Se-As alloy is vacuum deposited to the surface of the substrate. The result is a photoreceptor with a photosensitive layer of greater uniformity and evenness, and of better Se-As alloy adhesion to the aluminum substrate. The final result is picture images with less white point defects.

BRIEF DESCRIPTION OF THE DRAWINGS

FIG. 4(*a*) shows a pinhole caused by an Al burr. FIG. 4(*b*) shows a pinhole caused by wastage of grindstone grinding. FIG. 4(*c*) shows a pinhole caused by a flaw formed by loading of the grindstone.

DETAILED DESCRIPTION OF THE INVENTION

Figure 1:
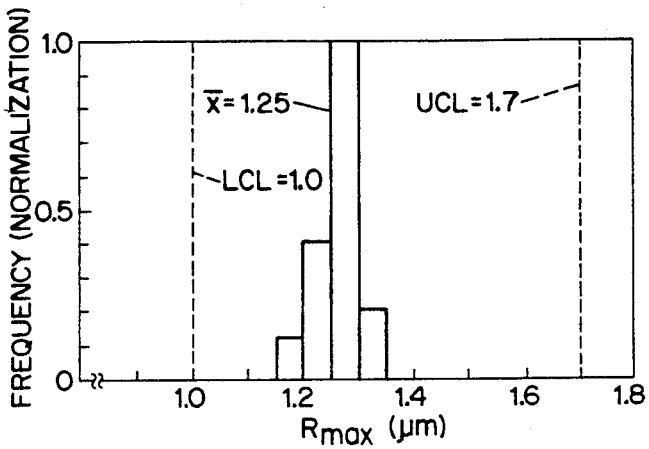
FIG. 1 shows the distribution of $R_{max}$ of Al substrate surface treated in accordance with the inventor.

In accordance with the present invention, a photoreceptor is produced by working the surface of an aluminum base substrate by diamond bite cutting, so that there is a $R_{max}$ of at least 1.3 microns, but not greater than 1.8 microns, and a filtered maximum waviness ($W_{CM}$) not exceeding 0.5 micron. $W_{CM}$ as used herein is defined in accordance with Japanese Industrial Standard B 0610-1976 as the maximum height of a wave extracted from a waviness curve obtained by removing the short wave length components of roughness from the surface profile.

After working, the aluminum surface is etched with an aqueous solution alkali and optionally etched with an aqueous solution of nitric acid to form an oxidized film thereon. A Se-As alloy is vacuum deposited on the surface to form a photosensitive layer.

The surface of an aluminum substrate treated in this manner becomes adaptable to the formation of the Se-As alloy vapor deposited thereon. The surface of the aluminum substrate is free from formation of burrs, flaws, and wastage of grindstone grinding cutting into the surface. The Se-As alloy adheres easily to the surface of the aluminum substrate, and this photosensitive layer is smooth and even, devoid of pinholes. As a result, it is possible to provide picture images in electrophotography wherein there are very few white point defects corresponding to pinholes in the photosensitive Se-As alloy layer.

EXAMPLE

The surface of a drum-shaped Aluminum substrate was cutting-worked with a diamond bite to have a $R_{max}$ of at least 1.3 microns but not exceeding 1.8 microns, and a $W_{CM}$ not exceeding 0.5 microns. After the Al substrate was washed with an organic solvent, it was immersed in an aqueous 3% solution of KOH at 40° C. for 3 minutes to apply etching to the surface of substrate. Subsequently, etching of the surface of the substrate was carried out in an aqueous 30% by weight solution of nitric acid at 40° C. for 20 minutes.

Figure 2:
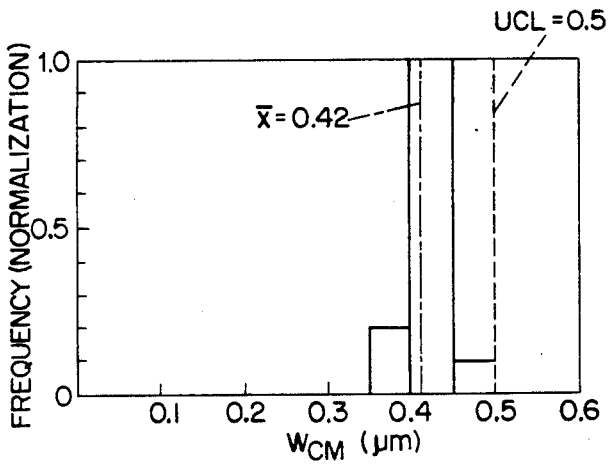
FIG. 2 shows the distribution of $W_{CM}$ of the same surface.
Figure 3:
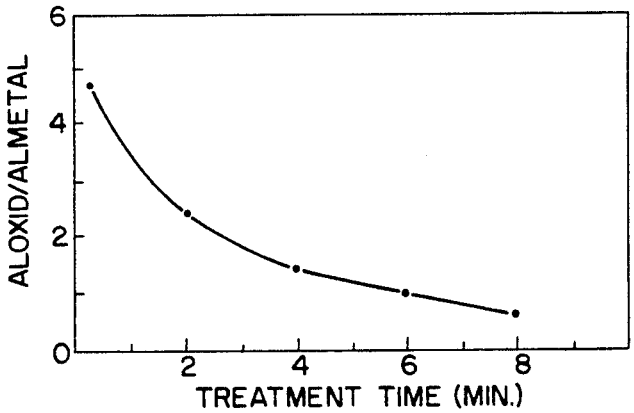
FIG. 3 shows the oxidized state of the same surface when an oxidized film of the surface is investigated by ESCA.
Figure 4A:
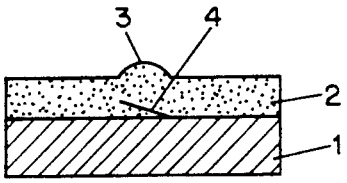
FIG. 4 is diagrammatical sectional views showing defects in a Se-As-containing photoreceptor produced using an Al substrate worked by the conventional grindstone grinding, which pinholes are classified by causes.
Figure 4B:
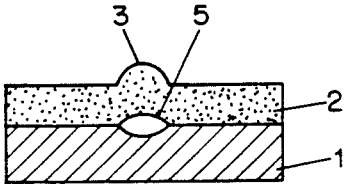
Figure 4C:
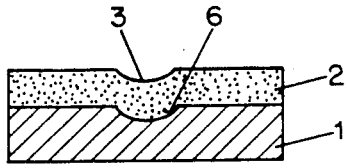

Thirty-four aluminum substrates, after being surface-worked and treated like this, were measured for $R_{max}$ and for $W_{CM}$. The measurement result, the distribution of $R_{max}$, is shown in FIG. 1. The distribution of $W_{CM}$ is shown in FIG. 2. Further, the degree of oxidation (Al oxide/Al metal) of the surface of Al substrate was investigated. It was 1.5 on the surface after being cutting-worked and it was increased to 5 on the surface after being etching-treated with an aqueous solution of nitric acid. The result of the investigation of the oxidized state of the aluminum substrate surface by ESCA is shown in FIG. 3. From FIG. 3, it was found that an oxidized film was formed on the surface of the Aluminum substrate.

$As_2Se_3$ was vacuum-deposited on the surface of the aluminum substrate after it was worked mechanically and etched. The result was a good photoreceptor, having a photosensitive layer that was smooth and even, almost free from formation of defects such as pinholes. It adhered easily to the aluminum substrate surface. The photoreceptor of the example and the photoreceptor of the conventional example were investigated for the percent of defective image obtained. The results are shown in Table 1.

TABLE 1

| | Example | Conventional example |
|---|---|---|
| Appearance defective | 15% | 20% |
| Image defective | 2% | 4% |

The photoreceptor of the example has a substantially reduced percentage of defect so that it is clear that the method of the example is an excellent method to produce the photoreceptor.

As mentioned above, if the surface of aluminum substrate, after being cutting-worked to have a desired surface shape, is etched with an aqueous solution of alkali, the surface of Aluminum substrate is converted into a state having good adhesion properties for a Se-As vapor-deposited film, having the appropriate roughness. Therefore, a smooth and even photosensitive layer can be formed on the above-mentioned surface by vacuum depositing the Se-As alloy, even when a subsequent etching treatment with an aqueous solution of nitric acid is not applied to the surface. If an etching treatment with an aqueous solution of nitric acid is applied to the surface of aluminum substrate after being etched with an aqueous solution of alkali, an oxidized film is formed on the surface, and the surface is converted into a more suitable surface, having improved adaptability and adhesion to the Se-As alloy vapor-deposited film.

We claim:

1. A method for producing a photoreceptor for electrophotography comprising (a) working an aluminum base substrate with a diamond bite to achieve a finish in which $R_{max}$ to between 1.3 and 1.8 microns and the filtered maximum waviness does not exceed 0.5 micron;

(b) etching the worked aluminum base substrate with an aqueous solution of alkali to convert the aluminum into a state having good adhesion properties for a Se-As vacuum-deposited film; and (c) vacuum depositing a Se-As alloy on the surface of the etched aluminum base substrate.

2. A method for producing a photoreceptor for electrophotography according to claim 1, wherein the aluminum base substrate after being etched with an aqueous solution of alkali, is etched with an aqueous solution of nitric acid to form an oxidized film on the aluminum base substrate before the Se-As alloy is vacuum deposited thereon.

* * * * *